US008919156B1

(12) United States Patent
Liu

(10) Patent No.: US 8,919,156 B1
(45) Date of Patent: Dec. 30, 2014

(54) CORE REPLACEABLE HOCKEY LOCK

(71) Applicant: Federal Lock Co., Ltd., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 14/186,264

(22) Filed: Feb. 21, 2014

(51) Int. Cl.
*E05B 67/36* (2006.01)
*E05B 67/02* (2006.01)

(52) U.S. Cl.
CPC ..... *E05B 67/02* (2013.01); *E05B 67/36* (2013.01)
USPC ..... 70/32; 70/371; 70/373

(58) Field of Classification Search
CPC ..... E05B 9/084; E05B 9/086; E05B 63/0056; E05B 67/38; E05B 67/36; E05B 65/48; E05B 83/12
USPC ..... 70/2, 6–12, 32–34, 370–375, 379 R, 380
See application file for complete search history.

(56) References Cited

U.S. PATENT DOCUMENTS 4,672,828 A * 6/1987 Theriault ..... 70/373
4,920,774 A * 5/1990 Martin ..... 70/367
5,127,244 A * 7/1992 Myers ..... 70/2
5,907,963 A * 6/1999 Myers et al. ..... 70/371
6,105,405 A * 8/2000 Westwinkel ..... 70/371
6,338,261 B1 * 1/2002 Liu ..... 70/34
6,758,075 B1 * 7/2004 Thwing ..... 70/389
6,883,356 B1 * 4/2005 Wu ..... 70/379 R
RE38,832 E * 10/2005 Thwing ..... 70/389
7,003,994 B2 * 2/2006 Ruan ..... 70/416
7,536,887 B2 * 5/2009 Makino ..... 70/379 R
7,895,867 B2 * 3/2011 Hsieh ..... 70/379 R
8,240,178 B2 * 8/2012 Massard et al. ..... 70/379 R
8,336,349 B2 * 12/2012 Thimmappa et al. ..... 70/371
8,776,557 B2 * 7/2014 Wang ..... 70/34
2002/0144527 A1 * 10/2002 Dalsing et al. ..... 70/373
2005/0011239 A1 * 1/2005 Lurie et al. ..... 70/369
2005/0072197 A1 * 4/2005 Evans et al. ..... 70/375
2005/0252257 A1 * 11/2005 Woods et al. ..... 70/33
2008/0105005 A1 * 5/2008 Wang ..... 70/32

* cited by examiner

*Primary Examiner* — Suzanne Barrett
(74) *Attorney, Agent, or Firm* — Morton J. Rosenberg

(57) ABSTRACT

A core replaceable hockey lock includes a housing having a space defined therein. An installation hole is defined in one end thereof and a slit is defined in the inner periphery of the installation hole. An insertion hole is defined in the housing and communicates with the slit. A deadbolt is rotatably installed in the installation hole and has a recess which is located corresponding to the slit. The deadbolt has at least one passive member connected thereto which is located in one end of the housing. A positioning plate is inserted in the slit and the recess to axially position the deadbolt. A positioning pin is inserted into the insertion hole and positions the positioning plate. The hockey lock can use different cores installed therein such as six-bead core, seven-bead core or bead-replaceable core. The user needs only one key to unlock all of the hockey locks.

12 Claims, 12 Drawing Sheets

CORE REPLACEABLE HOCKEY LOCK

BACKGROUND OF THE INVENTION

1. Fields of the Invention

The present invention relates to a hockey lock, and more particularly, to a core replaceable hockey lock.

2. Descriptions of Related Art

The conventional hockey lock is used on gate doors and disclosed in FIGS. 1 to 2, and generally comprises a casing 10 having a key hole 101 which has a connection hole 102 defined in an inside thereof. The connection hole 102 has a core 20 received therein, the core 20 has a slide slot 201 and is connected to a deadbolt 202. The key hole 101 has a recess 103 located corresponding to the connection hole 102. A threaded hole 104 is defined in the casing 10 and located on the same side as the lock hole 102. The threaded hole 104 is located corresponding to the slide slot 201. A bolt 30 is threadedly connected to the threaded hole 104 and reaches the slide slot 201 so that the core 20 is movable within a pre-set distance.

However, the outer contour of the core 20 has to be matched with the shape of the connection hole 102 of the casing 10 so that the core 20 can be installed in the casing 10. The deadbolt 202 and the core 20 are fixed to each other and cannot be detached from each other. The different types of the cores 20 has different structure, safety level and anti-theft feature, so that the different cores 20 have different shapes and outer contour, and this restricts the replacement of different cores 20. In other words, the cores 20 do not have a common standard. For example, the hockey lock used to factories is different from the hockey lock used to home and garages. Different hockey locks have to be unlocked by different keys, therefore, the users have to carry multiple keys. The users may be confused by the multiple keys and the hockey locks, and therefore the users need more time to match the specific key with the specific hockey lock. Besides, if the core 20 is damaged, the whole assembly of the casing 10 and the core 20 have to be discarded, and a new hockey lock is purchased which increases the economy burden. The manufacturers have to prepare multiple hockey locks in stock.

The present invention intends to provide a core replaceable hockey lock which improves the shortcomings mentioned above.

SUMMARY OF THE INVENTION

The present invention relates to a hockey lock and comprises a housing having a space defined therein. An installation hole is defined in one end of the housing. A slit is defined in the inner periphery of the installation hole. An insertion hole is defined in the housing and communicates with the slit. A deadbolt is rotatably installed in the installation hole and has a recess which is located corresponding to the slit. The deadbolt has at least one passive member connected thereto which is located in one end of the housing. A positioning plate is inserted in the slit and the recess so as to axially position the deadbolt. A positioning pin is inserted into the insertion hole and positions the positioning plate.

Preferably, a bridge member is fixed in the space and has a positioning portion.

Preferably, the housing has a fixing hole and the bridge member has a connection hole which is located corresponding to the fixing hole. A positioning member extends through the fixing hole and the connection hole to fix the bridge member to the space.

Preferably, the positioning plate is a curved plate and has a flat face which is located corresponding to the positioning pin.

Preferably, the length of the recess is longer than the length of the positioning plate.

Preferably, the at least one passive member includes multiple rods.

Preferably, the at least one passive member is a geometric recess.

Preferably, a core is installed in the space of the housing and connected to the at least one passive member so as to rotate the deadbolt.

Preferably, the bridge member is mounted to a core, and the core and the bridge member are located in the space. The core is connected to the at least one passive member to synchronically rotate the deadbolt.

Preferably, the housing has a slide slot defined in the outside thereof.

Preferably, a casing has a lock hole and a room is defined in the casing and communicates with the outside of the casing. The room has a passage which communicates with the lock hole. The casing has a recessed area which communicates with the passage. The recessed area has at least one engaging portion. The housing is located in the room. The casing has a positioning hole which is located corresponding to the slide slot. The positioning hole is located in the same side as the lock hole. A positioning unit is inserted into the positioning hole and the slide slot so that the casing is movable and restricted by the slide slot and the positioning unit. The deadbolt has a surface and a groove located corresponding to the at least one engaging portion. The deadbolt is inserted into the passage. When locking the hockey lock, the deadbolt is inserted into the recessed area by the surface and rotated to engage the at least one engaging portion with the groove.

The primary object of the present invention is to provide a hockey lock that can be cooperated with different types of cores so as to unify the cores. Therefore, the user needs only one key to be able to unlock all of the hockey locks. The manufacturers has less economy burden to store multiple cores in stock.

The housing of the present invention is able to be cooperated with different types of cores. Alternatively, the core can be connected with the bridge member and then both of which are installed in the space of the housing. The positioning plate and the positioning pin axially position the deadbolt so that the deadbolt is rotatable and does not drop. The deadbolt is connected to the core by the passive members according to the type of the core. The core is synchronically rotatable with the deadbolt so that the user can replace different types of cores such as the six-bead core, the seven-bead core or the bead-replaceable core. Therefore, the user can easily manage the locks and increase the safety feature. When the core is to be replaced, the user simply purchases a new core, while the casing does not to be replaced. The user can replace other locks with the core that is the same as the front door lock so that the user needs only one key to unlock all of the locks. This is convenient for the user to manage the locks and reduces the expenses for purchasing new locks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
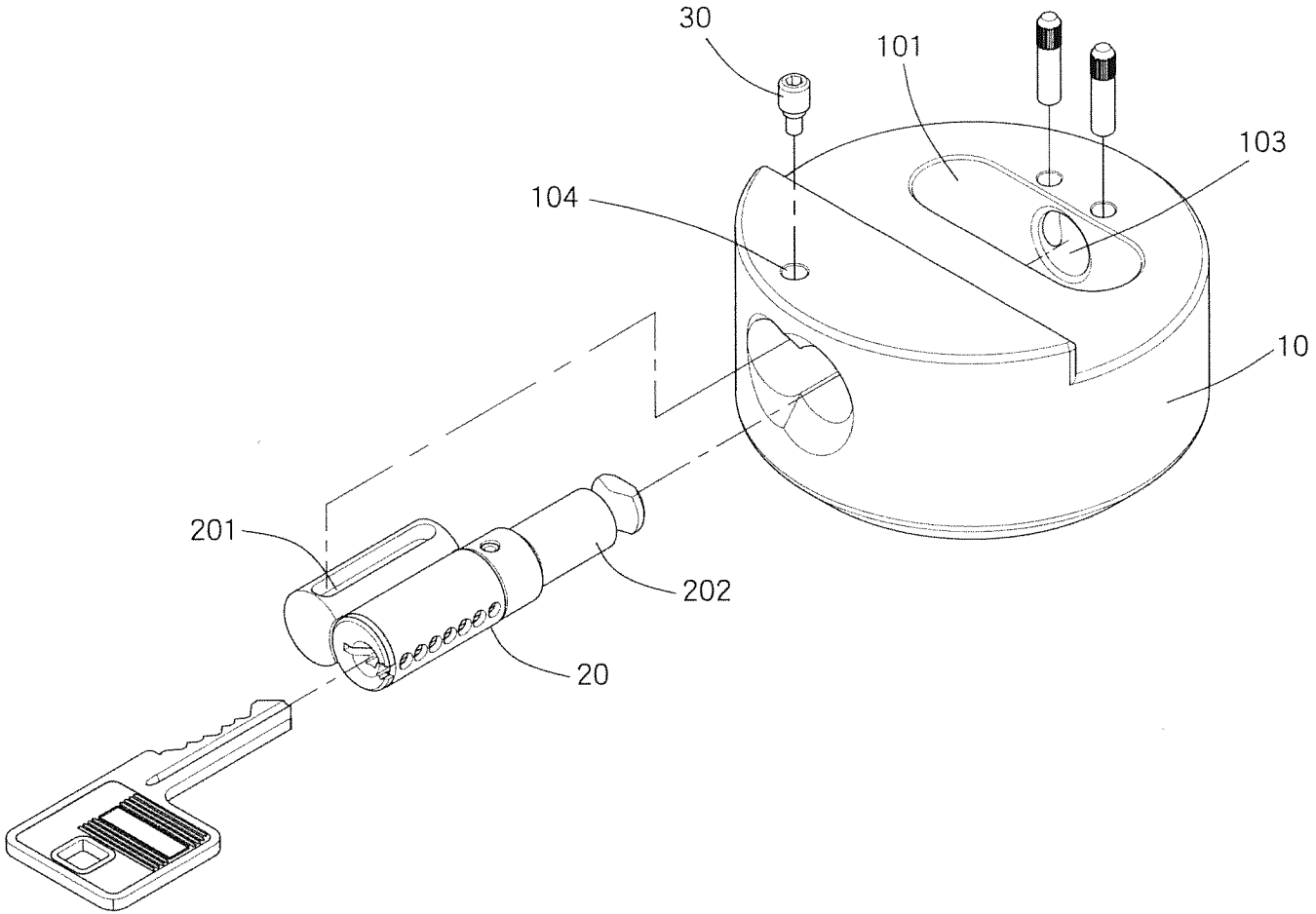
FIG.1(PRIOR ART)
FIG. 1 is an exploded view of the conventional hockey lock.
Figure 2:
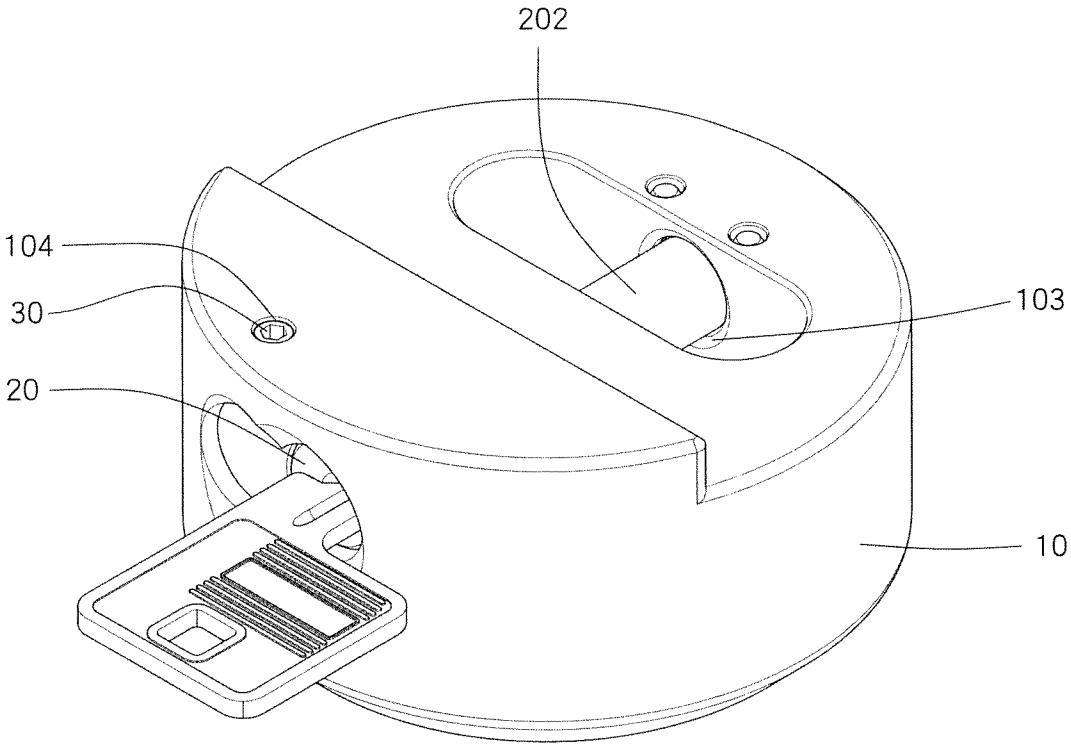
FIG.2(PRIOR ART)
FIG. 2 is a perspective view to show the conventional hockey lock.

Referring to FIGS. 3 to 8, the hockey lock of the present invention comprises a housing 1 having a space 11 defined therein. An installation hole 12 is defined in one end thereof and a slit 121 is defined in the inner periphery of the installation hole 12. An insertion hole 13 is defined in the housing 1 and communicates with the slit 121. The housing 1 further has a slide slot 14 defined in the outside thereof.

A deadbolt 2 is rotatably installed in the installation hole 12 and has a recess 21 which is located corresponding to the slit 121. The deadbolt 2 has at least one passive member 22*a* connected thereto which is located in one end of the housing 1. The at least one passive member 22*a* includes multiple rods.

A positioning plate 3 is inserted in the slit 121 and the recess 21 so as to axially position the deadbolt 2. The length of the recess 21 is longer than the length of the positioning plate 3.

A positioning pin 4 is inserted into the insertion hole 13 and positions the positioning plate 3. The positioning plate 3 is a curved plate and has a flat face which is located corresponding to the positioning pin 4.

A core 5*a* is installed in the space 11 of the housing 1 and connected to the at least one passive member 22*a* so as to rotate the deadbolt 2.

A casing 6 has a lock hole 61, and a room 62 is defined in the casing 6 and communicates with outside of the casing 6. The room 62 has a passage 621 which communicates with the lock hole 61. The casing 6 has a recessed area 63 which communicates with the passage 621. The recessed area 63 has at least one engaging portion 631. The housing 1 is located in the room 62. The casing 6 has a positioning hole 64 which is located corresponding to the slide slot 14, and the positioning hole 64 is located in the same side as the lock hole 61. A positioning unit 7 is inserted into the positioning hole 64 and the slide slot 14 so that the casing 6 is movable and restricted by the slide slot 14 and the positioning unit 7. The deadbolt 2 has a surface 23 and a groove 24 located corresponding to the at least one engaging portion 631. The deadbolt 2 is inserted into the passage 621. When locking the hockey lock, the deadbolt 2 is inserted into the recessed area 63 by the surface 23 and rotated to engage the at least one engaging portion 631 with the groove 24.

Figure 3:
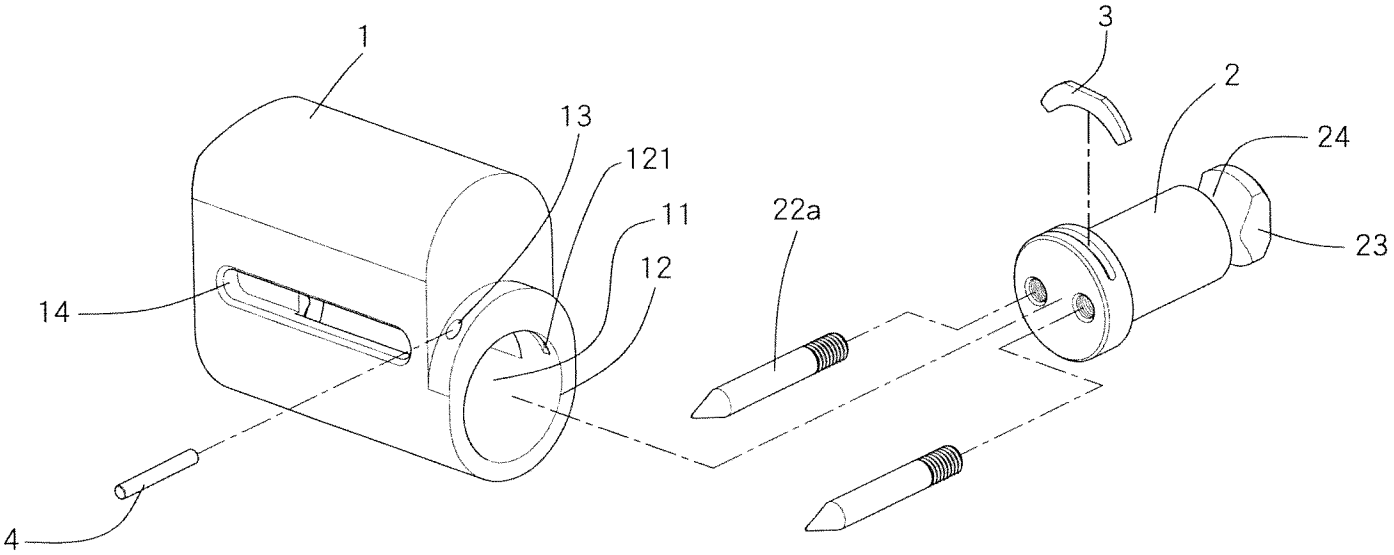
FIG. 3 is an exploded view of the hockey lock of the present invention.
Figure 4:
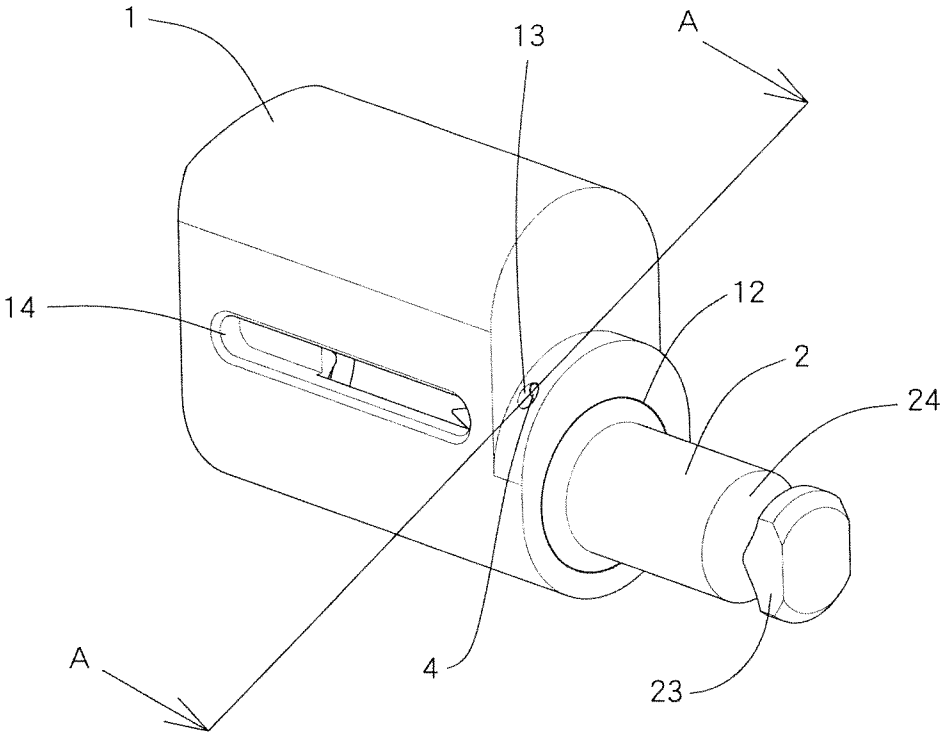
FIG. 4 is a perspective view to show the hockey lock of the present invention.
Figure 5:
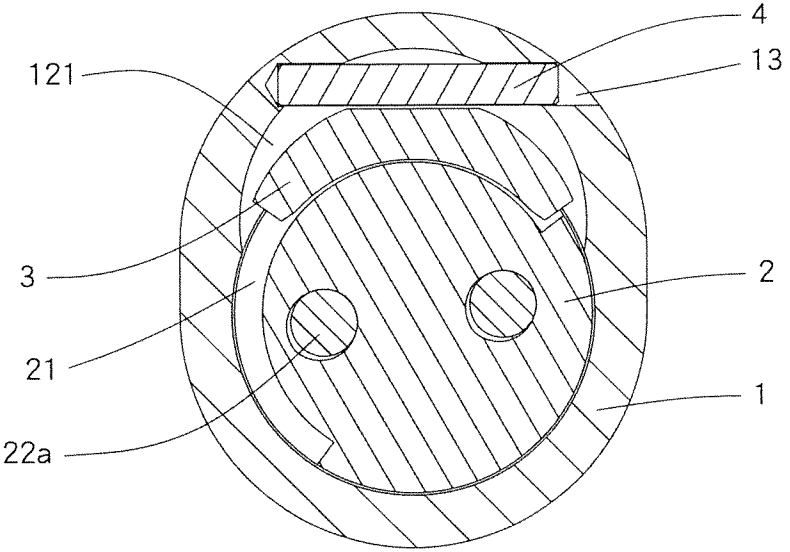
FIG. 5 is a cross sectional view, taken along line A-A of FIG. 4.

As shown in FIGS. 3 to 5, the positioning plate 3 is inserted into the slit 121 of the housing 1, and the recess 21 of the deadbolt 2 is located corresponding to the slit 121. The positioning pin 4 is then inserted into the slit 121 via the insertion hole 13 so as to be contact the flat face of the positioning plate 3. The positioning plate 3 is partially inserted into the recess 21 to axially position the deadbolt 2. Because the length of the recess 21 is longer than the length of the positioning plate 3, therefore, the deadbolt 2 is rotatable when it is axially positioned.

Figure 6:
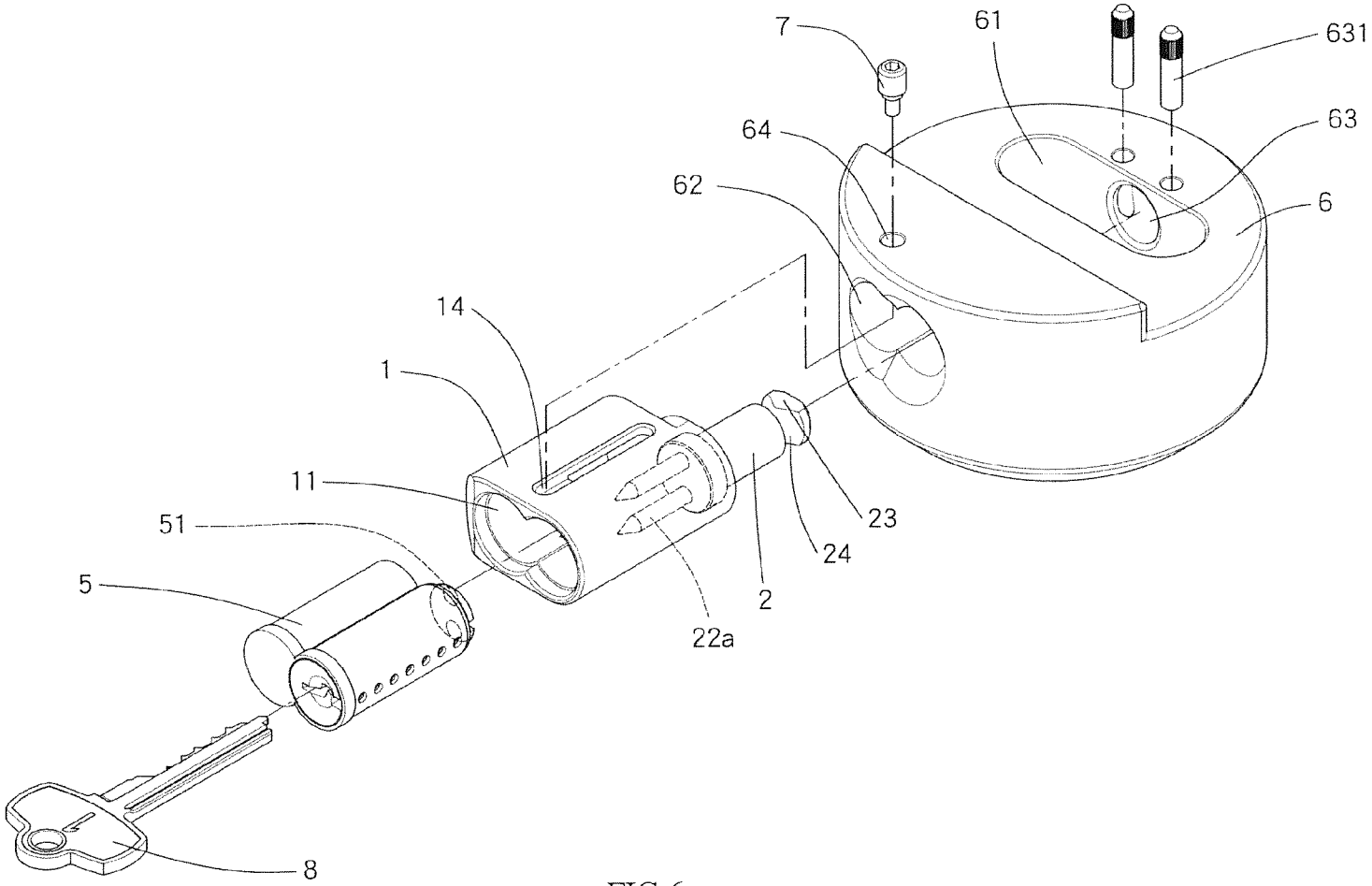
FIG. 6 is an exploded view to show that the hockey lock and the casing.
Figure 7:
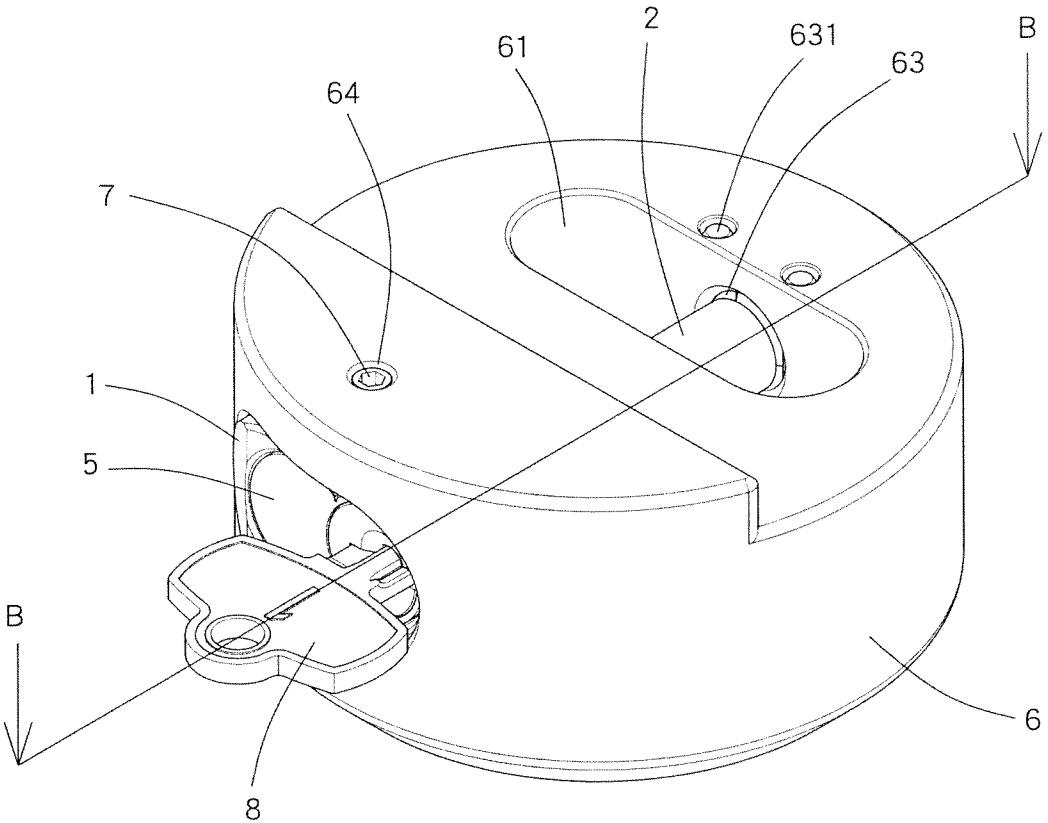
FIG. 7 is a perspective view to show that the hockey lock is cooperated with the casing.
Figure 8:
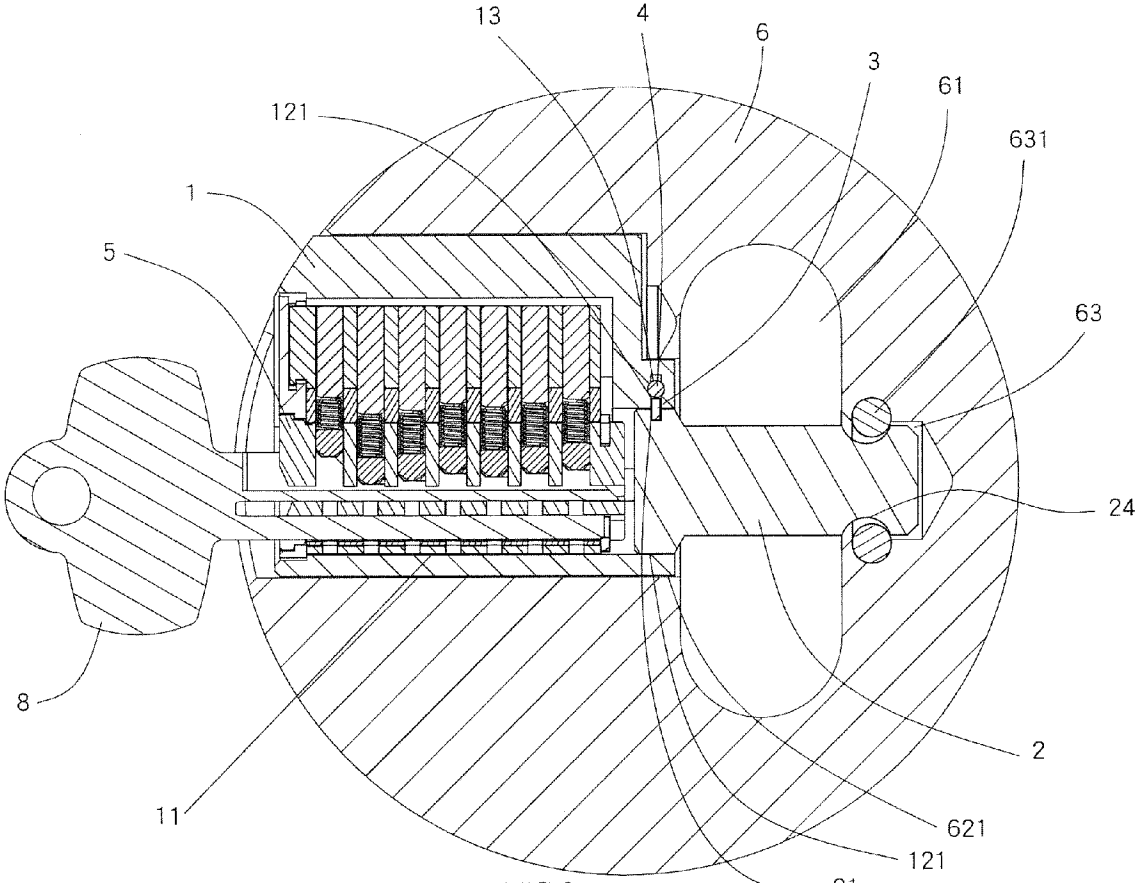
FIG. 8 is a cross sectional view, taken along line B-B of FIG. 7.
Figure 9:
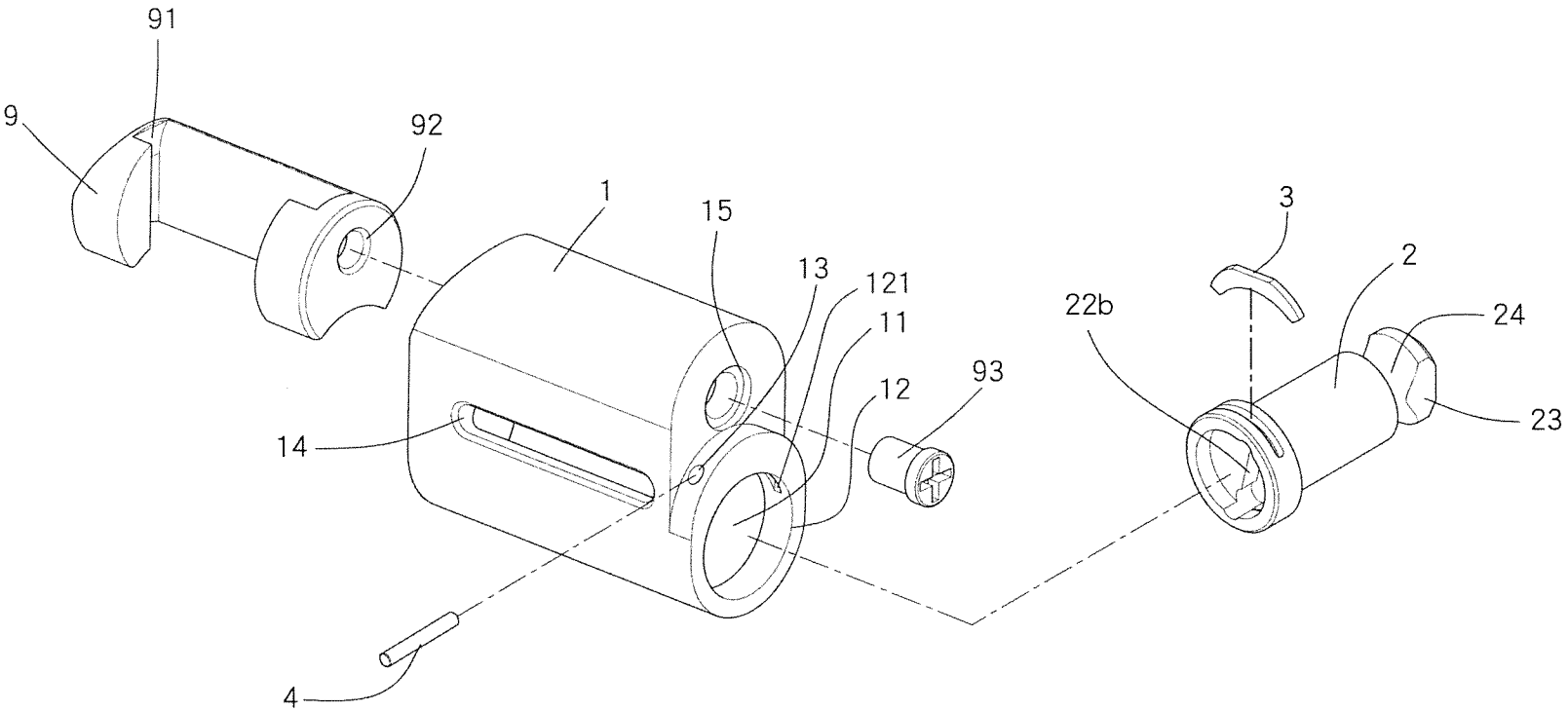
FIG. 9 is an exploded view of the second embodiment of the hockey lock of the present invention.
Figure 10:
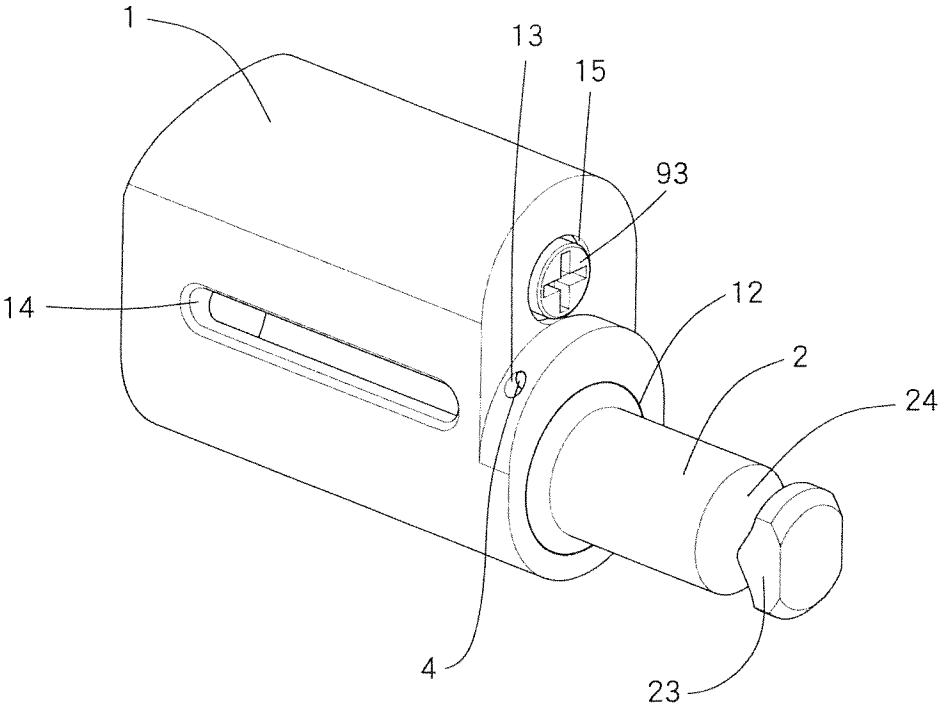
FIG. 10 is a perspective view to show the second embodiment of the hockey lock of the present invention.

As shown in FIGS. 6 to 8, when the housing 1 and the deadbolt 2 are installed together, the core 5*a* of the passive member 22*a* of the deadbolt 2 is simply installed in the space 11 of the housing 1, and the core 5*a* is connected to the passive member 22*a*, the deadbolt 2 can be extended through the passage 621 of the room 62 of the casing 6, so that the housing 1 and the core 5*a* are installed in the room 62 of the casing 6. By the positioning unit 7 extending through the positioning hole 64 and inserted into the slide slot 14, the housing 12 can be moved within a pre-set level so that the housing 12 does not drop from the casing 6. It is noted that the core 5*a* has two passive holes 51 so that there are passive members 22*a* (two rods) in this embodiment of the present invention. The two passive members 22*a* are inserted into the passive holes 51 so that when the core 5*a* is rotated, the passive members 22*a* can be driven via the passive holes 51. Therefore the deadbolt 2 is rotated. The passive members 22*a* and the core 5*a* can be different shapes and forms. The core 5*a* can be six-bead core 5*a* or seven-bead core 5*a*. Alternatively, the core 5*a* can be a bead-replaceable core 5*a*.

When a key 8 is inserted into the core 5*a* and rotated, the core 5*a* rotates the deadbolt 2. When the hockey lock is in locked status, the flat surface 23 of the deadbolt 2 is parallel to the engaging portion 631 of the recessed area 63. The width of the deadbolt 2 is reduced because of the flat surface 23 so that the deadbolt 2 can be extended through the engaging portion 631 of the recessed area 63 by the flat surface 23, and the groove 24 of the deadbolt 2 is located corresponding to the engaging portion 631. When the core 5*a* is rotated, the flat surface 23 of the deadbolt 2 is perpendicular to the engaging portion 631, so that the deadbolt 2 is engaged with the engaging portion 631 via the groove 24 to lock the hockey lock. On the contrary, when the core 5*a* is rotated to let the flat surface 23 of the deadbolt 2 to be parallel to the engaging portion 631 of the recessed area 63, the deadbolt 2 can be removed from the recessed area 63 to unlock the hockey lock.

As shown in FIGS. 9 to 12, the second embodiment is disclosed and the difference from the first embodiment is that the passive member 22*b* is a geometric recess. The second embodiment further has a bridge member 9 which is fixed in the space 11 and has a positioning portion 91. The housing 1 has a fixing hole 15. The bridge member 9 has a connection hole 92 which is located corresponding to the fixing hole 15. A positioning member 93 extends through the fixing hole 15 and the connection hole 92 to fix the bridge member 9 to the space 11.

The bridge member 9 is mounted to a core 5*b* by the positioning portion 91. The core 5*b* and the bridge member 9 are located in the space 11. The core 5*b* is connected to the passive member 22*b* so as to synchronically rotate the deadbolt 2.

Figure 11:
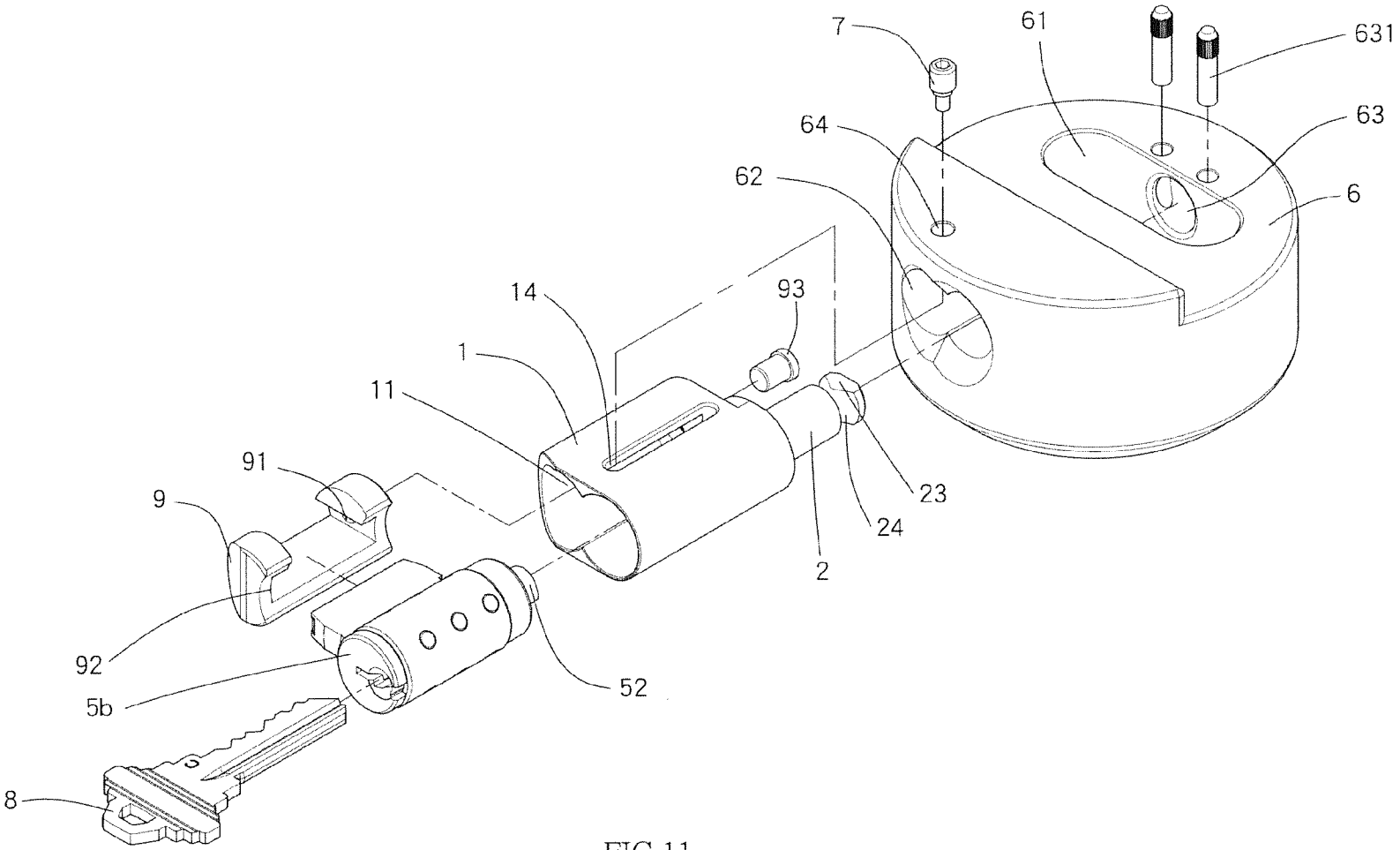
FIG. 11 is an exploded view to show the second embodiment of the hockey lock and the casing.
Figure 12:
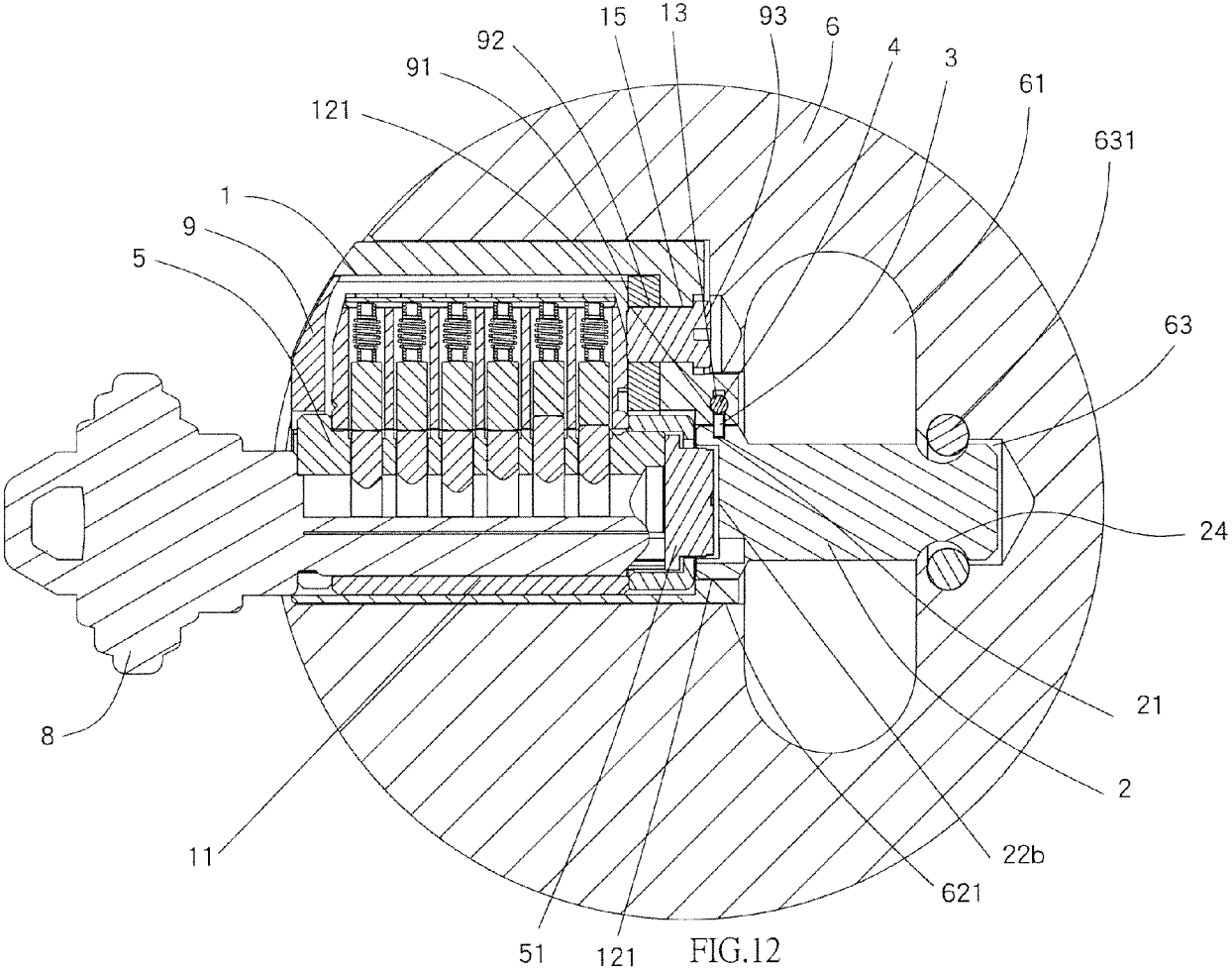
FIG. 12 is a cross sectional view to show that the second embodiment of the hockey lock is cooperated with the casing.

As shown in FIGS. 11 and 12, the core 5*b* can be a bead-replaceable core 5*b*. The core 5*b* can also be different systems of cores such as the six-bead core 5*b* or seven-bead core 5*b*.

Because the core 5*b* cannot be directly installed into the housing 1 so that the bridge member 9 is mounted to the top of the core 5*b* by the positioning portion 91, so that the shape of the combination of the core 5*b* and the bridge member 9 is suitable for the space 11 of the housing 1. The positioning member 93 is securely connected to the fixing hole 15 and the connection hole 92 to secure the core 5*b* in the housing 1. The core 5*b* has a geometric protrusion 52 at the distal end thereof, so that the passive member 22*b* has a recess that is suitable for accommodating the protrusion 52. The deadbolt 2 is synchronically rotatable with the core 5*b*. The shapes of the passive member 22*b* and the core 5*b* can be vary. The rest portions of the second embodiment are similar to those described regarding to the first embodiment.

While we have shown and described the embodiment in accordance with the present invention, it should be clear to those skilled in the art that further embodiments may be made without departing from the scope of the present invention.

What is claimed is:

1. A hockey lock comprising:

a housing having a space defined therein, an installation hole defined in one end thereof and a slit defined in an inner periphery of the installation hole, an insertion hole defined in the housing and communicating with the slit;

a deadbolt rotatably installed in the installation hole and having a recess which is located corresponding to the slit, the deadbolt having at least one passive member connected thereto which is located in one end of the housing;

a positioning plate inserted in the slit and the recess so as to axially position the deadbolt, and a positioning pin inserted into the insertion hole and positioning the positioning plate.

2. The hockey lock as claimed in claim 1, wherein a bridge member is fixed in the space and has a positioning portion.

3. The hockey lock as claimed in claim 2, wherein the housing has a fixing hole, the bridge member has a connection hole which is located corresponding to the fixing hole, a positioning member extends through the fixing hole and the connection hole to fix the bridge member in the space.

4. The hockey lock as claimed in claim 1, wherein the positioning plate is a curved plate and has a flat face which is located corresponding to the positioning pin.

5. The hockey lock as claimed in claim 4, wherein a length of the recess is longer than a length of the positioning plate.

6. The hockey lock as claimed in claim 1, wherein the at least one passive member includes multiple rods.

7. The hockey lock as claimed in claim 1, wherein the at least one passive member is a geometric recess.

8. The hockey lock as claimed in claim 1, wherein a core is installed in the space of the housing and connected to the at least one passive member so as to rotate the deadbolt.

9. The hockey lock as claimed in claim 2 further comprising a core to which the bridge member is mounted, the core and the bridge member are located in the space, the core is connected to the at least one passive member to synchronically rotate the deadbolt.

10. The hockey lock as claimed in claim 3 further comprising a core to which the bridge member is mounted, the core and the bridge member are located in the space, the core is connected to the at least one passive member to synchronically rotate the deadbolt.

11. The hockey lock as claimed in claim 1, wherein the housing has a slide slot defined in an outside thereof.

12. The hockey lock as claimed in claim 11 further comprising a casing which has a lock hole, a room is defined in the casing and communicating with an outside of the casing, the room having a passage which communicates with the lock hole, the casing having a recessed area which communicates with the passage, the recessed area having at least one engaging portion, the housing located in the room, the casing having a positioning hole which is located corresponding to the slide slot, the positioning hole located in the same side as the lock hole, a positioning unit inserted into the positioning hole and the slide slot so that the casing is movable and restricted by the slide slot and the positioning unit, the deadbolt having a flat surface and a groove located corresponding to the at least one engaging portion, the deadbolt being inserted into the passage, when locking the hockey lock, the deadbolt is inserted into the recessed area by the flat surface and rotated to engage the at least one engaging portion with the groove.

* * * * *